United States Patent [19]

Eskelinen

[11] Patent Number: 4,694,587

[45] Date of Patent: Sep. 22, 1987

[54] METHOD AND APPARATUS IN A TWIN-WIRE CYLINDER DRYING SECTION OF A PAPER MACHINE

[75] Inventor: Pekka Eskelinen, Turku, Finland

[73] Assignee: Valmet Oy, Finland

[21] Appl. No.: 905,180

[22] Filed: Sep. 9, 1986

[30] Foreign Application Priority Data

Sep. 13, 1985 [FI] Finland ..... 853525

[51] Int. Cl.[4] ..... F26B 3/24; F26B 13/08

[52] U.S. Cl. ..... 34/23; 34/41; 34/116; 34/117; 34/123

[58] Field of Search ..... 34/23, 116, 123, 117, 34/41

[56] References Cited

U.S. PATENT DOCUMENTS 3,388,479 6/1968 Gardner ..... 34/116

4,602,439 7/1986 Eskelinen et al. ..... 34/116

*Primary Examiner*—Larry I. Schwartz

*Attorney, Agent, or Firm*—Steinberg & Raskin

[57] ABSTRACT

A twin-wire drying section of a paper machine includes upper and lower rows of drying cylinders, an upper drying wire guided by the upper drying cylinders and upper guide rolls situated between the upper drying cylinders, and a lower drying wire guided by the lower drying cylinders and lower guide rolls situated between the lower drying cylinders. A web is pressed by the upper wire in direct drying contact with the surfaces of the upper drying cylinders and is pressed by the lower wire in direct drying contact with the surfaces of the lower drying cylinders and has a free draw of a certain length between a drying cylinder of one row and a drying cylinder of another row. In accordance with the invention, a vacuum zone in arranged on a run of a drying wire between a drying cylinder and the next guide roll which causes the web to be suctioned against the drying wire so that the length of the free run of the web is substantially shortened. The suction is created by directing air jets in directions opposite to the running directions of the drying wire run and the guide roll which eject air from spaces behind them thereby creating the vacuum zone.

14 Claims, 5 Drawing Figures

METHOD AND APPARATUS IN A TWIN-WIRE CYLINDER DRYING SECTION OF A PAPER MACHINE

BACKGROUND OF THE INVENTION

The present invention relates to a method in a twin-wire drying section of a paper machine which includes upper and lower rows of drying cylinders, an upper drying wire guided by surfaces of the upper drying cylinders and upper guide rolls situated between them and a lower drying wire guided by surfaces of the lower drying cylinders and lower guide rolls situated between them, wherein a web is pressed by the upper wire in direct drying contact with the surfaces of the upper drying cylinders and is pressed by the lower wire in direct drying contact with the surfaces of the lower drying cylinders, the web having a free draw of a certain length between a drying cylinder of one row and a drying cylinder of another row.

The invention also relates to apparatus for use in such twin-wire drying sections and which are adapted to be situated between adjacent drying cylinders in spaces bounded by adjacent drying wire runs and the free sectors of the guide rolls guiding the drying wire.

As used in this application, the term single-wire draw refers to an arrangement wherein a wire runs over heated drying cylinders in a manner such that the web runs from one cylinder row to the other cylinder row while supported by the drying wire so that the web is between the drying wire and the surface of the drying cylinder in one cylinder row while in the other cylinder row the drying wire is situated between the surface of the cylinder and the web. An advantage of the single-wire draw drying section is that the web is always supported by the drying wire and has no free draws, or at least no free draws of any substantial length, which thereby reduces the danger of web breakage.

The term twin-wire draw is used in this application to refer to the well-known arrangement in which a top wire is used in association with a row of top cylinders and a bottom wire is used in association with a row of bottom cylinders, the bottom wire being guided by surfaces of the drying cylinders and by guide rolls positioned between the drying cylinders so that at the top cylinder row the web is pressed by the top wire in direct drying contact with the surfaces of the top cylinders and in the bottom cylinder row the web is pressed by the bottom wire into direct drying contact with the surfaces of the lower cylinders.

The present invention is particularly concerned with methods and apparatus for use in connection with drying sections of the twin-wire draw type.

In twin-wire draw drying sections, the web has a substantially long free draw between the cylinders of one row and the cylinders of the other row. The web tends to flutter over these free draws and there is a posibility of the web breaking or creasing during its run over the free draws. These drawbacks are particularly prevalent at the beginning of the drying section where the web is still relatively wet and therefore weak and sensitive to flutter.

Efforts have been made in the past to eliminate this drawback by shortening the free draws at the beginning of the drying section by positioning the top and bottom rows of drying cylinders closer to each other than they normally would be in the case where optimal drying efficiency would be obtained.

Another approach to overcoming these drawbacks has been to utilize single-wire draw arrangements in the third and fourth drying groups. However, this tends to lower evaporating efficiency and complicates ventilation arrangements, and, therefore is used only in emergency situations.

Efforts have also been made to reduce the flutter of the web by repositioning the wire guide rolls to shorten the unsupported run of the web. A drying group incorporating this feature is disclosed in U.S. Pat. No. 3,753,298. A Swedish paper machine wherein the guide rolls are positioned in accordance with U.S. Pat. No. 3,753,298 has attained speeds of up to 853 m/min as disclosed in an article "Engineering Consideration for Light Weight Paper Drying in High Speed Machines" in the publication *Paper Technology and Industry*, July/August, 1978. However, problems with web flutter have still been encountered.

The web flutter problem is discussed in a Finnish publication *Paperin Valmistus* (a textbook and manual III, Part 1 of the Finnish Paper Engineer's Association), pages 699 to 700, wherein it is stated that the flutter of web edges is not usually caused by air flow as is often assumed. If this is the case, the web flutter problem cannot be prevented by controlling air flow in the drying section which has often been attempted.

It is presently the opinion in the industry that web flutter is mainly the result of strong air current flows within the pockets defined within the drying section and by pressure differentials in the pockets as well as in the nips formed by the web, drying wire and cylinder surfaces. The strong air flows and pressure differentials are the consequence of boundary layer flows induced by the moving wire, web and cylinder surfaces.

The pockets mentioned above are formed by the free web draws, free cylinder surfaces, and wires or felts guided by guide rolls. These pockets are closed except at their transverse ends and the ventilation of the pockets is considered to be an important factor from the viewpoint of efficiency and uniformity of the moisture profile obtained.

The running speed of paper machines have been continuously increasing and are now approaching about 1500 m/min. The flutter of the free web draws becomes an even greater problem at such high machine speeds and hampers the runability of the paper machine. Although the passage of a web from the press section to the drying section and supporting the web over a single-wire draw drying section can be controlled with conventional arrangements, difficulties are still encountered in the twin-wire draw drying sections, particularly in the third and fourth dryer groups. Known arrangements are not intended to control the quantity of air being pumped into the pockets of the drying section in a manner so that the web is suctioned into engagement with the drying wire as the wire moves from the cylinder surface into the region of the pocket of the drying section. In particular, in twin-wire draw arrangements, the quantity of air being pumped into a pocket essentially depends on the speed of the machine, the geometry of the transport section and the permeability of the drying wire.

It is also conventional to control the moisture profile in the pockets by dividing blow pipes present in the pockets into transversely extending blocks or sections which can be opened and closed to regulate the quantity of air being blown into the pocket. In this connection, reference is made to Finnish Pat. No. 68,275 of Valmet Oy, assignee of the instant application.

SUMMARY OF THE INVENTION

It is an object of the present invention to provide new and improved methods and apparatus for substantially reducing web flutter on a free draw in a twin-wire drying section and thereby reduce stretching of the web and the risk of web breakage.

Another object of the present invention is to provide new and improved methods and apparatus for ventilating the pockets in a twin-wire drying section and to control the transverse moisture profile of the web.

Briefly, in accordance with the present invention, these and other objects are attained by providing an arrangement in a twin-wire drying section wherein as the web and drying wire leave a drying cylinder, the web is suctioned into engagement with the drying wire by means of a vacuum zone arranged in the region of the drying wire so that the length of the free run of the web is substantially shortened. The suction zone is created on a drying wire run leaving a cylinder and going to a next guide roll by directing a first air jet proximate to the drying wire run in a direction opposite to the running direction thereof while at the same time directing a second air jet proximate to the free sector of the next guide roll in a direction opposite to the direction of rotation thereof. These air jets eject air from spaces behind them thereby creating the vacuum zone which acts on at least a section of the drying wire run.

Apparatus in accordance with the invention includes a blow box extending over substantially the entire width of the drying cylinder and in which first and second nozzle slots are formed for directing the first and second air jets respectively in the manner described above.

In an arrangement in accordance with the invention, the web is suctioned into tight engagement with the drying wire at its input side, i.e., at the run of the drying wire where the wire is separated from the drying cylinder and runs over a substantially straight path to the next following guide roll. As described above, the web is maintained in contact with the drying wire run by directing the air jets in a direction opposite to the running direction of the drying wire and the guide roll so that a vacuum is created on the drying wire run approaching the input nip or wedge-shaped space between the wire and the guide roll, the input nip normally being at an over-pressure. Since the web will not run directly from one drying cylinder to the next drying cylinder but will, in accordance with the invention, follow the drying wire from the drying cylinder up to the guide roll, remaining in contact therewith up to a point where a horizontal plane intersects the surface of the guide roll, the free unsupported run of the web is considerably shortened and therefore stabilized. The invention also eliminates the unstable run of the web in the output nip between the drying cylinder and the dryng wire which is caused by an uncontrolled vacuum on both sides of the web which has resulted in web flutter in conventional arrangements.

The invention also enables the quantity of air being pumped into the pocket to be controlled through regulating the vacuum created by means of the air jets. For example, by regulating the pressure in the blow box, the velocity of the air jets can be regulated to control the vacuum created thereby. In this manner the quantity of air being pumped into the pockets can be carried out independently of the permeability of the drying wire.

Although not a necessary feature of the invention, the invention can be utilized to control with a single device both the quantity of air leaving the pocket as well as its tranverse distribution thereby influencing the moisture profile of the web. A control of the moisture profile of the web can be accomplished by directing a third air jet in the region of a run of the drying wire from the guide roll to the next drying cylinder in a direction opposite to the running direction of that drying wire run, preferably using the same blow box that provides the first and second air jets to create the vacuum zone described above. The third air jet creates an over-pressure which reduces the air flow being pumped through the wire. The third nozzle slot may be formed in the blow box through which the third air jet is discharged, the third nozzle slot being separated into a plurality of separate nozzle slots, each of which includes means for adjustably regulating the flow of air therethrough. Moisture profiling of the web is therefore carried out at the delivery end of the drying wire by either opening one or more of the separate nozzle slots which has a moisturizing effect on the wire as air will not be pumped out of the pocket at those regions or closing one or more of the nozzle slots which will have a drying effect on the wire since air will be pumped out at this point from the pocket. In this manner the moisture profile is controlled in exactly the opposite way as compared to conventional pocket ventilation methods.

An important advantage of the invention is that it enables the use of very open drying wires, i.e., drying wires whose permeability is very high. For example, drying wires having permeabilities in the range of between about 10,000 to 15,000 $m^3/m^2h$ can be used in the practice of the invention whereas conventional drying wires generally have permeabilities in the range of between about 1500 to 2000 $m^3/m^2h$. Since the drying wires have substantially greater permeability, evaporation on the cylinder through the wire increases thereby reducing the average moisture level in the pockets. Moreover, ventilation through the output nips between the cylinder and the drying wire also increases due to the greater permeability of the drying wires.

Another important advantage of the invention is that the guide rolls of the top wire can be positioned at a lower position than before and/or the guide rolls of the bottom wire can be positioned at higher positions than before, whereby the drying cylinders in each row can be located closer to each other thereby shortening the drying section and, consequently, the entire paper machine. Through the use of apparatus in accordance with the invention, the guide rolls of the top and bottom wires can even be located in substantially the same horizontal plane. This is to be contrasted with conventional arrangements wherein the top wire guide rolls are on a substantially higher level than the guide rolls of the bottom wire.

It will be understood that apparatus in accordance with the invention can be provided either only at critical points in a drying section or within the entire twin-wire group between both the top and bottom cylinders.

DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 2:
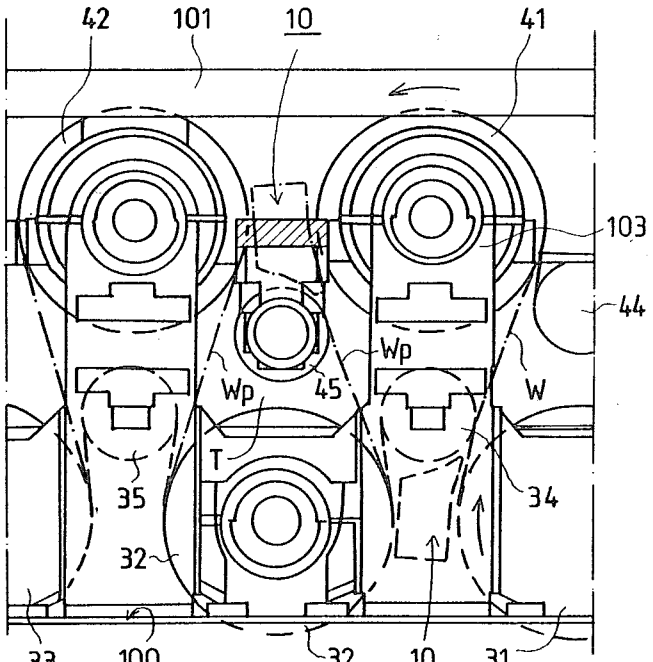
FIG. 2 is a view similar to FIG. 1, as seen from the drive side of the drying section.
Figure 1:
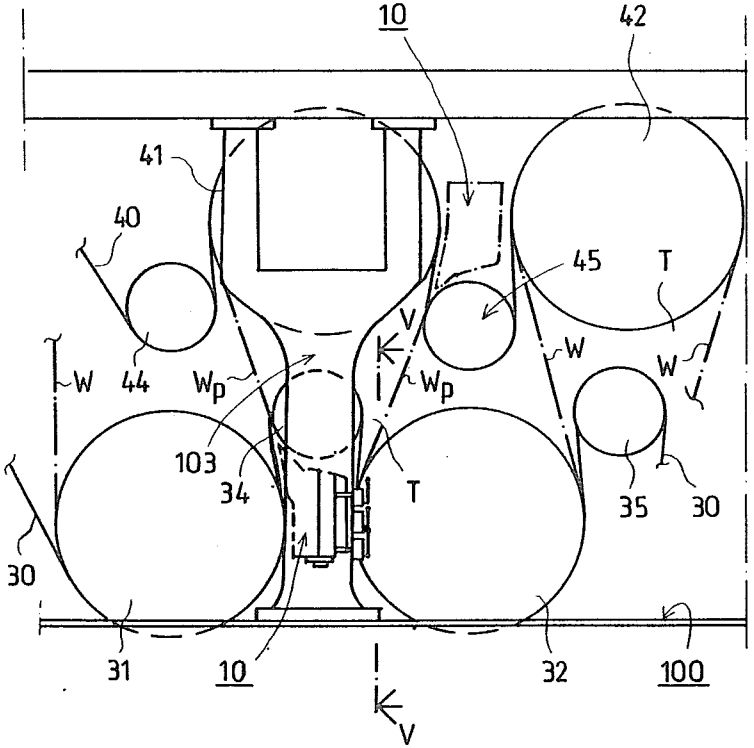
FIG. 1 is a schematic side elevation view of a twin-wire drying section in accordance with the invention, as seen from the maintenance side of the drying section.

Referring now to the drawings wherein like references characters designate identical or corresponding parts throughout the several views, and more particularly to FIGS. 1 and 2, a twin-wire drying section of a paper machine includes a row of upper drying cylinders 41, 42 and a row of lower drying cylinders 31, 32, an upper drying wire 40 guided by surfaces of the upper drying cylinders 41, 42 and upper guide rolls 44, 45 situated between the upper drying cylinders and a lower drying wire 30 guided by surfaces of the lower drying cylinders 31, 32 and lower guide rolls 34, 35 situated between the lower drying cylinders. A web W is pressed by the upper wire 40 in direct drying contact with the surfaces of the upper drying cylinders 41, 42 and is pressed by the lower wire 30 in direct drying contact with the surfaces of the lower drying cylinders 31, 32. The web has a free draw $W_p$ between drying cylinders of one row and drying cylinders of another row.

In accordance with the invention, blow boxes 10 extending transversely over substantially the entire width of the web W and the drying wires 30 and 40, are positioned in respective spaces, each of which is bounded by a first drying wire run leaving a first drying cylinder 31, 41 and going to a next guide roll 34, 45, a free sector of a next guide roll 34, 45, and a second drying wire run returning from the guide roll 34, 45 and going to a second drying cylinder 32, 42.

Figure 3:
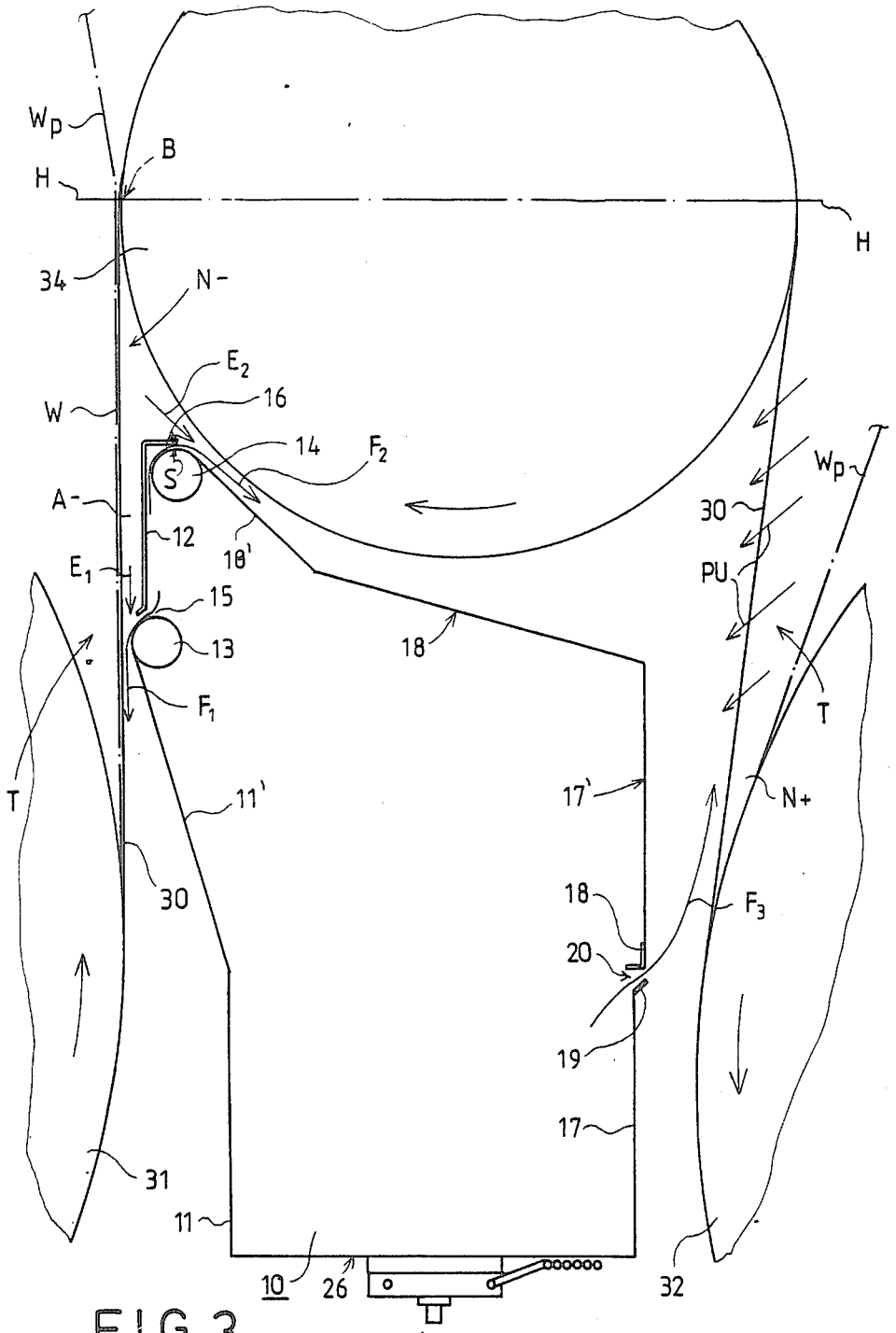
FIG. 3 is an enlarged schematic view of apparatus in accordance with the invention for performing methods in accordance with the invention.
Figure 4:
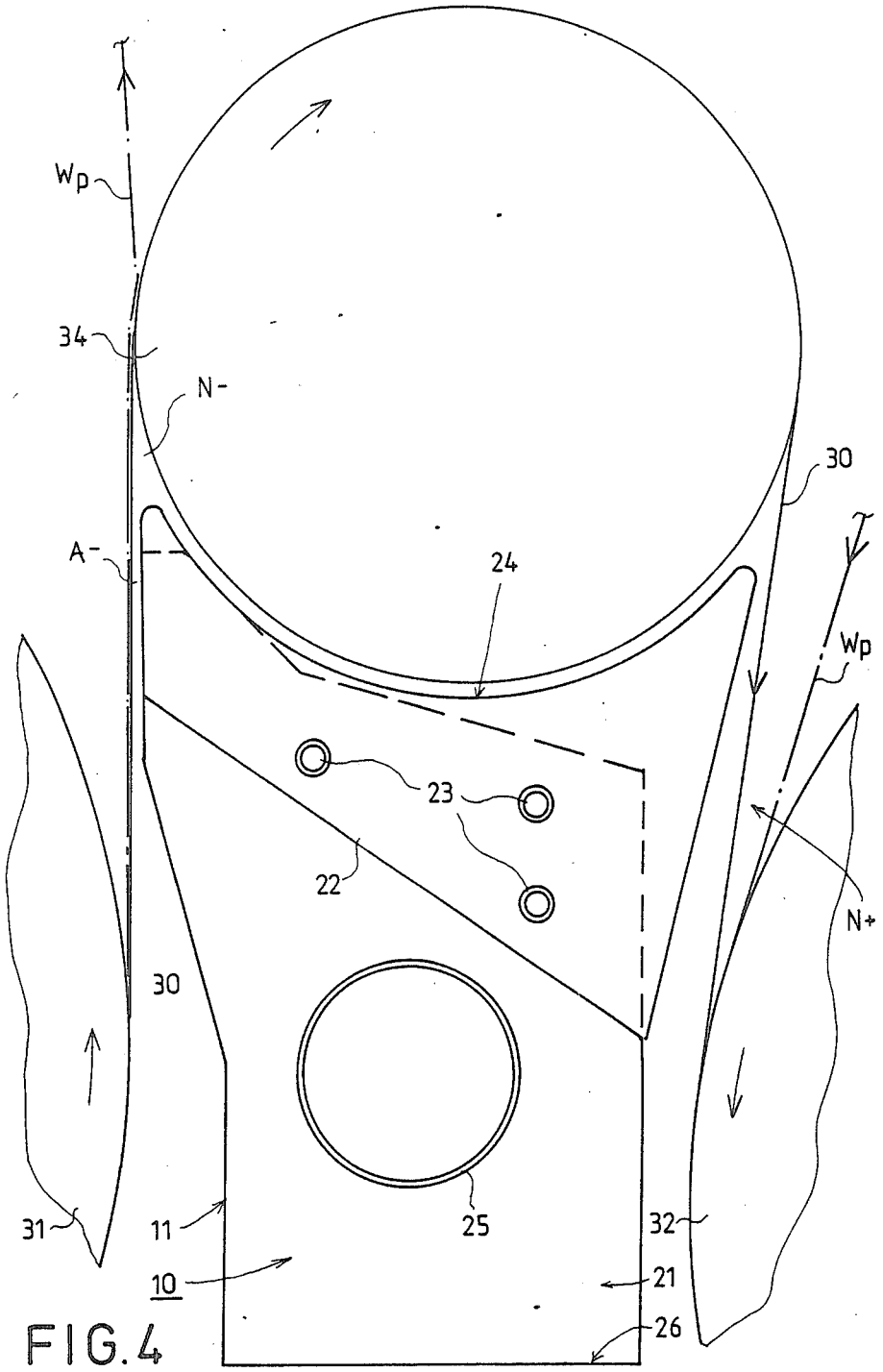
FIG. 4 is a view similar to FIG. 3 as seen from an end.
Figure 5:
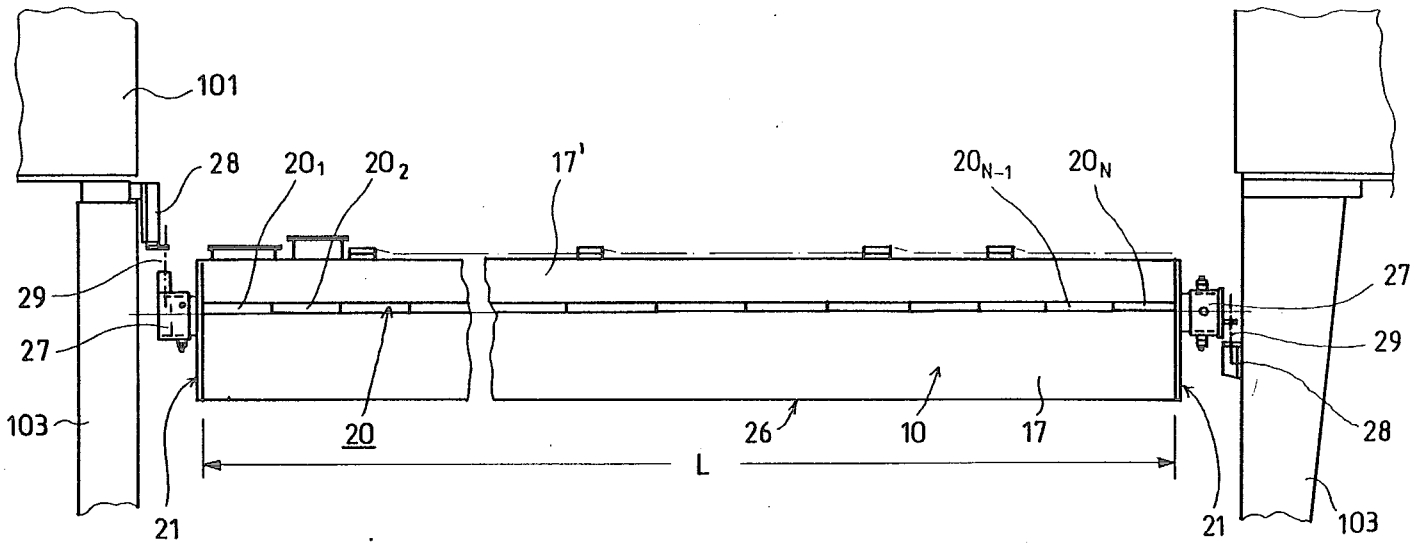
FIG. 5 is a view taken in the direction of line V—V of FIG. 1.

Referring to FIGS. 3 and 4 which illustrate the blow box 10 positioned in a space bounded by a first drying wire run leaving the first drying cylinder 31 and going to the next guide roll 34, a free sector of the next guide roll 34, and the second drying wire run returning from the guide roll 34 and going to the second drying cylinder 32, the blow box 10 includes substantially vertical walls 11, 11' and 17, 17', bottom wall 26 and top wall 18, 18', walls 18 and 18' facing the free sector of the guide roll 34. The edges of walls 11' and 18' are reinforced by tubular members 13 and 14 which extend over the entire width of the blow box 10. First and second nozzle slots 15 and 16 are defined by the tubular parts 13 and 14 and the edge regions of a substantially planar member 12. As seen in FIGS. 4 and 5, the opposite ends of the blow box 10 are closed by vertical walls 21, in one or both of which an air duct 25 is provided through which air is directed into the blow box. During operation, the air pressure within the blow box is preferably in the range of between about 1,000 to 1,500 Pa. As best seen in FIG. 4, plate members 22 are fastened to end walls 21 by screws 23 and have rounded outer edges 24 which follow as closely as possible the configuration of the free sector of the guide roll 34. Thus, the plate member 22 has a pair of protruding end regions which extend as far as possible into the nips or wedge-shaped spaces between the drying wire 30 and guide roll 34.

As seen in FIG. 5, the mounting members 27 extend from respective ends of the blow box 10 and the blow box 10 is installed in place by mounting the members 27 on brackets 28 of the frame sections 103 by means of set screws 29 or with a similar adjustable mounting by means of which the blow box 10 can be adjusted to the correct position with respect to the other components of the drying section. The length L of blow box 10 is preferably equal to or slightly smaller than the width of the drying wire 30.

Nozzle slot 15 is arranged so as to discharge a first air jet $F_1$ proximate to the first drying wire run in a direction opposite to the running direction thereof. The second nozzle slot 16 is arranged so as to direct a second air jet $F_2$ proximate to the free sector of the guide roll 34 in a direction opposite to the direction of rotation thereof.

The first and second air jets $F_1$ and $F_2$ eject air from the space A- between the drying wire 30 and the planar well member 12 of blow box 10 as well as from the wedge-shaped space N- between the drying wire 30 and the guide roll 34, the ejected air being designated by arrows $E_1$ and $E_2$. The ejection of air from the space A-, N- results in a vacuum zone being formed in this space which acts on at least a section of the first drying wire run extending from the drying cylinder 31 to the guide roll 34. The vacuum zone causes the web W to adhere to the drying wire 30, which is still relatively pervious to air, after the web separates from the surface of drying cylinder 31 and the web W remains in contact with the drying wire 30 up to the point where the nip N- terminates, i.e., up to point B at which the drying wire 30 engages the guide roll 34. The point of engagement B is substantially located at the point of intersection between the surface of the guide roll and a horizontal plane H-H passing through the axis of rotation of the guide roll 34. The web separates from the drying wire 30 only after the point B and then continues as a shortened free draw $W_p$ to the next drying cylinder 41.

The vacuum zone N-, A- created by the air jets $F_1$ and $F_2$ generally extends over one-half the length of the drying wire run between the drying cylinder 31 and guide cylinder 35 and the range of the vacuum zone N-, A- is preferably about 60% to 70% of the length of the first drying wire run.

The width S of nozzle slots 15 and 16 is generally in the range of between about 2 to 5 mm and the velocity of the air jets $F_1$ and $F_2$ at the nozzle slots 15 and 16 is generally in the range of between about 15 to 50 m/s.

It is understood that similar blow boxes may be positioned in the other spaces of the drying section such as illustrated in FIGS. 1 and 2.

Although not required in connection with the invention, a third nozzle slot 20 may be provided in the vertical wall of blow box 10 opposite from nozzle slot 15, 16 between the wall portions 17 and 17' of the blow box. The nozzle slot 20 is defined between walls 18 and 19 as seen in FIG. 3. The third nozzle slot 20 is adapted to direct a third air jet $F_3$ on the second run of the drying wire 30 returning from the guide roll 34 and going to the next drying cylinder 32 in a direction opposite to the running direction of the second drying wire run in order to prevent air from being pumped through the second drying wire run from the pockets defined within the drying section, as discussed in detail below.

Referring to FIG. 5, the third nozzle slot 20 is divided into or includes a plurality of separate nozzle slots $20_1 \ldots 20_N$. Each of the nozzle slots includes means for adjustably regulating the flow of air therethrough in a continuous manner. For example, an adjustable valve may be positioned in each nozzle slot which can be regulated to operate between a fully closed and fully open position. In this manner, the transverse distribution of the air jet $F_3$ composed of separate air jets emanating from respective nozzle slots $20_1 \ldots 20_N$, can be controlled. When a particular nozzle slot $20_1 \ldots 20_N$ is in a fully open condition, stronger air jet will be applied to the corresponding localized zone of the second drying wire run. Similarly, when one or more of the separate nozzle slots $20_1 \ldots 20_N$ is closed, pumping PU through the localized regions of the second drying wire run corresponding to those nozzle slots will be at a maximum and the moisture level of the web W will be reduced at those regions. Moreover, when the air jet $F_3$ is sufficiently strong, it may penetrate to some extent into the pocket of the drying section and ventilate the same, especially in the case where the drying wire is very permeable.

As seen in FIG. 1, in the case where a blow box 10 is positioned in consecutive spaces, i.e., a first blow box 10 is positioned in the space bounded by a first drying wire run leaving first drying cylinder 31 and going to guide roll 34, the free sector of guide roll 34, and the second drying wire run returning from the guide roll 34 and going to the second drying cylinder 32, and a second blow box 10 is positioned in the adjacent space bounded by a first drying wire run leaving the first drying cylinder 41 and going to the next guide roll 45, a free sector of guide roll 45, and a second drying wire run returning from the guide roll 45 and going to the second drying cylinder 42, the free draw $W_p$ between lower drying cylinder 31 and upper drying cylinder 41 and the free draw $W_p$ between upper drying cylinder 41 and lower drying cylinder 32 are essentially equal and substantially shorter than in conventional twin-wire drying sections. In essence, the length of the free draw $W_p$ is from the point of departure of the web from the guide roll 34, 45 to the point of engagement of the web with the next drying cylinder 41, 32.

As seen in FIGS. 1 and 3, the drying wire 30 and the free run $W_p$ of the web W arrives separately, in non-engaging relationship into the input nip N+of drying cylinder 32.

As noted above, the invention makes it possible to use drying wires having greater permeability than has been possible in convention twin-wire draw drying secitons. In particular, conventional drying wires of twin-wire drying sections have permeabilities in the range of between about 1,500 to 2,000 $m^3/m^2h$. The present invention allows the use of drying wires having permeabilities in the range of between about 5,000 $m^3/m^2h$ to 20,000 $m^3/m^2h$, and preferably in the range of between about 10,000 $m^3/m^2h$ to 15,000 $m^3/m^2h$.

It is conventional in paper machines to use single-wire draw drying sections in the first cylinder groups of the drying sections and twin-wire draw arrangements in the latter, usually the last three or four, groups. The invention may be utilized in one or more twin-wire draw groups in one or more spaces between the cylinders. It is thus feasible to use the invention in one or two twin-wire draw groups comprising the first groups in the running direction of the web where the web is most susceptible to fluttering due to its strength and moisture qualities.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method in a twin-wire drying section of a paper machine which includes upper and lower rows of drying cylinders, an upper drying wire guided by surfaces of said upper drying cylinders and upper guide rolls situated between said upper drying cylinders, a lower drying wire guided by surfaces of said lower drying cylinders and lower guide rolls situated between said lower drying cylinders, wherein a web in pressed by said upper wire in direct drying contact with the surfaces of said upper drying cylinders and is pressed by said lower wire in direct drying contact with the surfaces of said lower drying cylinders, said web having a free draw of a certain length between the drying cylinder of one row and a drying cylinder of another row, comprising the steps of in a space bounded by a first drying wire run leaving a first drying cylinder and going to a next guide roll, a free sector of said next guide roll, and a second drying wire run returning from said next guide roll and going to a second drying cylinder, directing a first air jet proximate to said first drying wire run in a direction opposite to the running direction thereof;

at the same time directing a second air jet proximate to said free sector of said next guide roll in a direction opposite to the direction of rotation thereof;

said first and second air jets ejecting air from spaces behind them thereby creating a vacuum zone acting on at least a section of said first drying wire run;

said vacuum zone causing said web to be suctioned against said drying wire so that said certain length of said free web draw between a cylinder of one row and a cylinder of another row is substantially shortened;

directing a third air jet on said second run of said drying wire returning from said next guide roll and going to said second drying cylinder in a direction opposite to the running direction of said second drying wire for preventing air from being pumped through said second drying wire run from pockets defined within said drying section; and regulating the distribution of said third air jet in the transverse direction of said drying wire to control the transverse moisture profile of the web.

2. The method of claim 1 wherein said first and second air jets are directed such that said vacuum zone acts on a section of said first drying wire run which extends for over one-half the length of said first drying wire run.

3. The method of claim 2 wherein said first and second air jets are directed such that said vacuum zone acts on a section of said first drying wire run which extends for a length in the range of between about 60% to 70% of the length of said first drying wire run.

4. The method of claim 1 wherein said first and second air jets are directed such that said vacuum zone extends into an input nip at which said first drying wire run engages said next guide roll.

5. The method of claim 1 wherein said first and second air jets are directed with velocities in the range of between about 15 to 50 meters per second.

6. The method of claim 1 wherein said upper and lower drying wires have permeabilities in the range of between about 5,000 to 20,000 $m^3/m^2h$.

7. The method of claim 6 wherein said permeabilities are in the range of between about 10,000 to 15,000 $m^3/m^2h$.

8. The method of claim 1 wherein said first and second air jets are directed such that said vacuum zone causes said web to remain in contact with said drying wire over a length thereof extending from said first drying cylinder substantially to a point of engagment with said next guide roll, at which point said web separates from said drying wire.

9. The method of claim 8 wherein said point of engagement of said drying wire with said next guide roll is in a region at which a horizontal plane passing through a central axis of said guide roll intersects the surface of said guide roll.

10. In a twin-wire drying section of a paper machine which includes upper and lower rows of drying cylinders, an upper drying wire guided over surfaces of said upper drying cylinders and upper guide rolls situated between said upper drying cylinders, a lower drying wire guided over surfaces of said lower drying cylinders and lower guide rolls situated between said lower drying cylinders, each of said drying wires forming at least one space bounded by a first drying wire run leaving a first cylinder and going to a next guide roll, a free sector of said following guide roll, and a second drying wire run returning from said next guide roll and going to a second drying cylinder, and wherein a web is pressed by said upper wire in direct drying contact with the surfaces of said upper drying cylinders and is pressed by said lower wire in direct drying contact with the surfaces of said lower drying cylinders, said web having a free draw of a certain length between a drying cylinder of one row and a drying cylinder of another row, apparatus comprising;

air jet means comprising a blow box situated in said space including first nozzle means extending over substantially the width of said drying wire for directing a first air jet proximate to said first drying wire run in a direction opposite to the running direction thereof and including second nozzle means extending over substantially the width of said drying wire for directing a second air jet proximate to said free sector of said next guide roll in a direction opposite to the direction of rotation thereof, said first and second air jets ejecting air from spaces behind them thereby creating a vacuum zone acting on a least a section of said first drying wire run which causes the web to be suctioned against said drying wire so that said certain length of said free web draw between a cylinder of one row and a cylinder of another row is substantially shortened, said blow box including third nozzle slot means extending over substantially the width of said drying wire for directing a third air jet proximate to said second drying wire run returning from said guide roll and going to said second drying cylinder in a direction opposite to the running direction of said drying wire run, said third nozzle slot means including a plurality of separate nozzle slots, each of said nozzle slots including means for adjustably regulating the flow of air therethrough, whereby the distribution of said third air jet over the width of said drying wire and transverse to the running direction of the web can be controlled to thereby control a pumping effect through said second drying wire run to thereby control the moisture profile of the web.

11. The combination of claim 10 wherein said blow box includes an outer substantially planar wall portion, said first nozzle slot to which said first air jet is discharged proximate to said drying wire in a direction opposite to the running direction thereof is located substantially at a first edge of said planar wall portion, and wherein said second nozzle slot through which said second air jet is discharged proximate to said free sector of said next guide roll in a direction opposite to the direction of rotation thereof is located at a second edge of said planar wall portion opposite from said first edge.

12. The combination of claim 10 wherein said first nozzle slot is situated at a substantial mid-region of said first drying wire run and wherein said second nozzle slot is situated in a region of a nip formed by said first drying wire run and said next guide roll.

13. The combination of claim 12 wherein said first nozzle slot is offset from a mid-point of said first drying wire run in the direction of said first drying cylinder.

14. The combination of claim 10 wherein said upper and lower guide rolls are situated substantially in a common horizontal plane.

* * * * *